US010401761B2

(12) United States Patent
Sakurai et al.

(10) Patent No.: US 10,401,761 B2
(45) Date of Patent: Sep. 3, 2019

(54) DEVELOPING DEVICE AND IMAGE FORMING APPARATUS

(71) Applicant: Konica Minolta, Inc., Tokyo (JP)

(72) Inventors: Shota Sakurai, Machida (JP); Takenobu Kimura, Hachioji (JP); Tomohiro Kawasaki, Sagamihara (JP); Wataru Watanabe, Hachioji (JP); Ryoei Ikari, Tokorozawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/041,231

(22) Filed: Jul. 20, 2018

(65) Prior Publication Data

US 2019/0033750 A1 Jan. 31, 2019

(30) Foreign Application Priority Data

Jul. 28, 2017 (JP) ..... 2017-146761

(51) Int. Cl.

| | |
|---|---|
| ***G03G 15/08*** | (2006.01) |
| ***G03G 15/20*** | (2006.01) |
| ***G03G 15/02*** | (2006.01) |
| ***G03G 15/00*** | (2006.01) |

(52) U.S. Cl.

CPC ..... *G03G 15/0887* (2013.01); *G03G 15/02* (2013.01); *G03G 15/0856* (2013.01); *G03G 15/0865* (2013.01); *G03G 15/2028* (2013.01); *G03G 15/556* (2013.01); *G03G 15/757* (2013.01)

(58) Field of Classification Search

USPC ..... 399/27

See application file for complete search history.

(56) References Cited

U.S. PATENT DOCUMENTS

| | | | | |
|---|---|---|---|---|
| 2007/0104515 | A1* | 5/2007 | Akedo | G03G 15/0893 399/254 |
| 2009/0310985 | A1* | 12/2009 | Hirata | G03G 15/0887 399/30 |
| 2010/0322670 | A1* | 12/2010 | Ishiguro | G03G 15/0853 399/254 |

FOREIGN PATENT DOCUMENTS

| | | |
|---|---|---|
| JP | 2012173536 A | 9/2012 |

* cited by examiner

*Primary Examiner* — Quana Grainger
(74) *Attorney, Agent, or Firm* — Lucas & Mercanti, LLP

(57) ABSTRACT

A developing device includes: a developing roller that carries a developer; a developing tank that supplies the developing roller with the developer replenished from a replenishing port; a discharger that has a discharge port connecting to the developing tank and discharges the developer from the developing tank; a supply amount acquirer that acquires a supply amount of the developer to be supplied to the developing tank; a discharge amount acquirer that acquires a discharge amount of the developer to be discharged through the discharge port; a developer amount adjuster that adjusts an amount of the developer in the developing tank; and a hardware processor that controls the developer amount adjuster to adjust the amount of the developer in the developing tank to a value within a predetermined range, in accordance with the acquired supply amount and the acquired discharge amount of the developer.

20 Claims, 11 Drawing Sheets

DEVELOPING DEVICE AND IMAGE FORMING APPARATUS

The entire disclosure of Japanese patent Application No. 2017-146761, filed on Jul. 28, 2017, is incorporated herein by reference in its entirety.

BACKGROUND

Technological Field

The present invention relates to a developing device and an image forming apparatus.

Description of the Related Art

In a conventional image forming apparatus such as a copying machine, a printer, or the like, it is known that a trickle development method can be adopted. By the trickle development method, a new developer is supplied to a developing device that houses a two-component developer (hereinafter simply referred to as a "developer") containing toner and a carrier (see JP 2012-173536 A, for example).

The trickle development method is designed for replenishing the inside of a developing device with a new developer, and discharging part of the developer housed in the developing device to the outside of the developing device, so that the number of degraded carriers in the developing device is reduced, and the amount and the charging ability of the carrier housed in the developing device are maintained. With an image forming apparatus using such a trickle development method, it is possible to achieve stable output image quality.

In a developing device adopting the trickle development method, however, the amount of the developer in the developing device greatly fluctuates depending on coverage, environmental temperature and humidity, the installation state of the developing device, and the like. Because of this, there is a problem that the toner concentration in the developer is not stabilized, and image defects such as fogging and image density fluctuations are caused. Further, in a developing device adopting the trickle development method, there is a problem that the necessary amount of the developer cannot be supplied to the developing roller, resulting in image unevenness. Particularly, in small-sized developing devices and developing devices to be driven at high speed in the field of production printing, it is difficult to stabilize the amount of the developer in a developing device, and the above problems are easily caused.

To counter the above problems, the technique disclosed in JP 2012-173536 A is designed to provide a carrier concentration detecting means in a developing device, predict the amount of the carrier to be injected into the developing device from the detected carrier concentration and the developer replenishment time, and control the rotation speed or the like of the stirring member in accordance with the predicted value. However, it is considered that the technique disclosed in JP 2012-173536 A does not provide a structure for maintaining the amount of the developer at a constant value in the developing device, and it is difficult to prevent the amount of the developer from fluctuating. Further, it is considered that a change in the rotation speed of the stirring member affects toner concentration control and, eventually, the quality of printed images, and therefore, such a change should not be frequently made.

SUMMARY

An object of the present invention is to provide a developing device and an image forming apparatus capable of reducing fluctuations of the amount of the developer in the developing device while maintaining the highest possible printed image quality.

To achieve the abovementioned object, according to an aspect of the present invention, a developing device reflecting one aspect of the present invention comprises: a developing roller that carries a developer; a developing tank that supplies the developing roller with the developer replenished from a replenishing port; a discharger that has a discharge port connecting to the developing tank and discharges the developer from the developing tank; a supply amount acquirer that acquires a supply amount of the developer to be supplied to the developing tank; a discharge amount acquirer that acquires a discharge amount of the developer to be discharged through the discharge port; a developer amount adjuster that adjusts an amount of the developer in the developing tank; and a hardware processor that controls the developer amount adjuster to adjust the amount of the developer in the developing tank to a value within a predetermined range, in accordance with the acquired supply amount and the acquired discharge amount of the developer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 6B is a diagram showing water levels outside the normal range;

FIG. 7A is a diagram showing an example of water levels in the normal range, and FIGS. 7B and 7C are diagrams showing water levels of the developer in a case where a connecting width is increased and in a case where the connecting width is reduced;

DETAILED DESCRIPTION OF EMBODIMENTS

Figure 1:
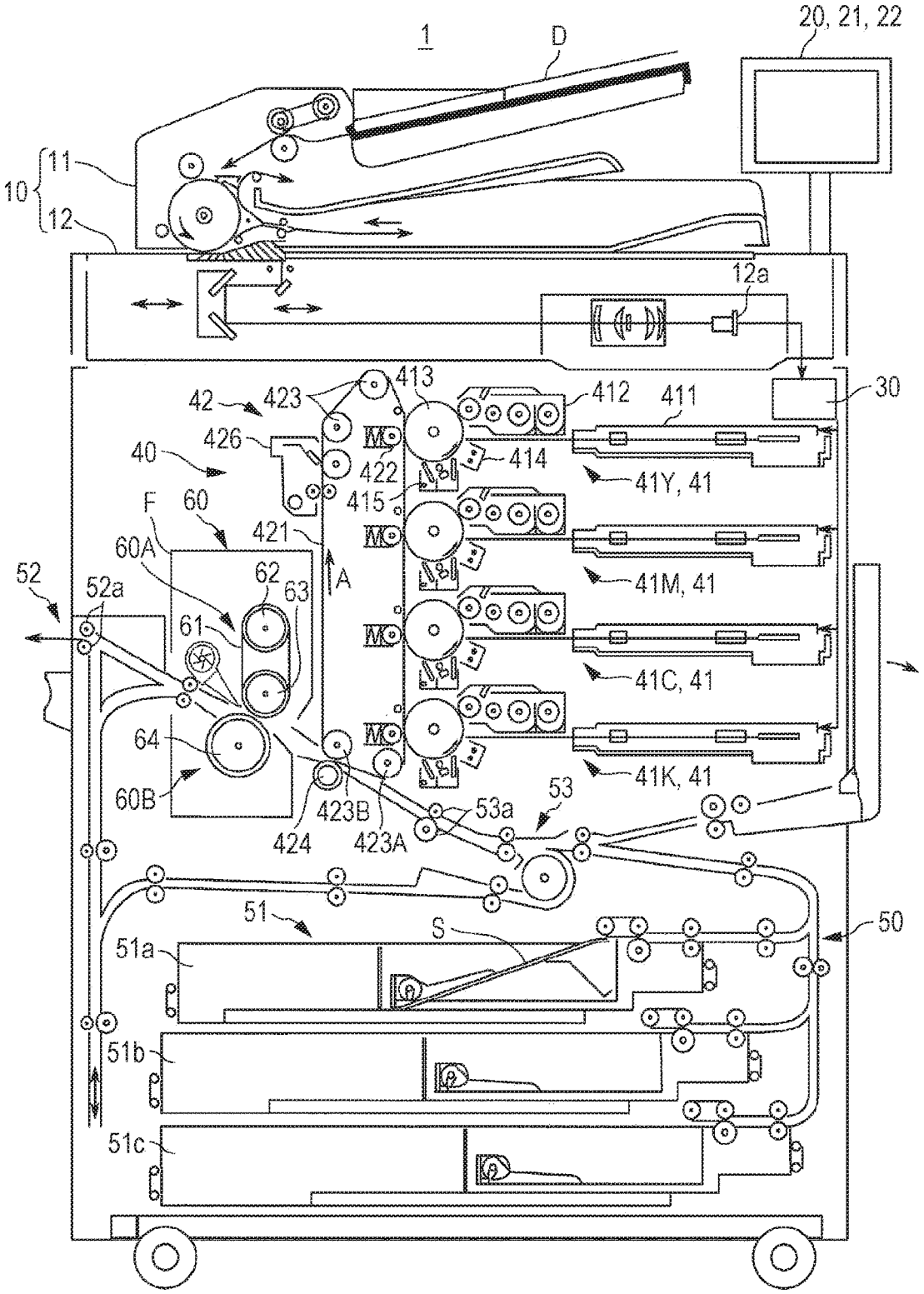
FIG. 1 is a diagram schematically showing the entire structure of an image forming apparatus according to an embodiment.
Figure 2:
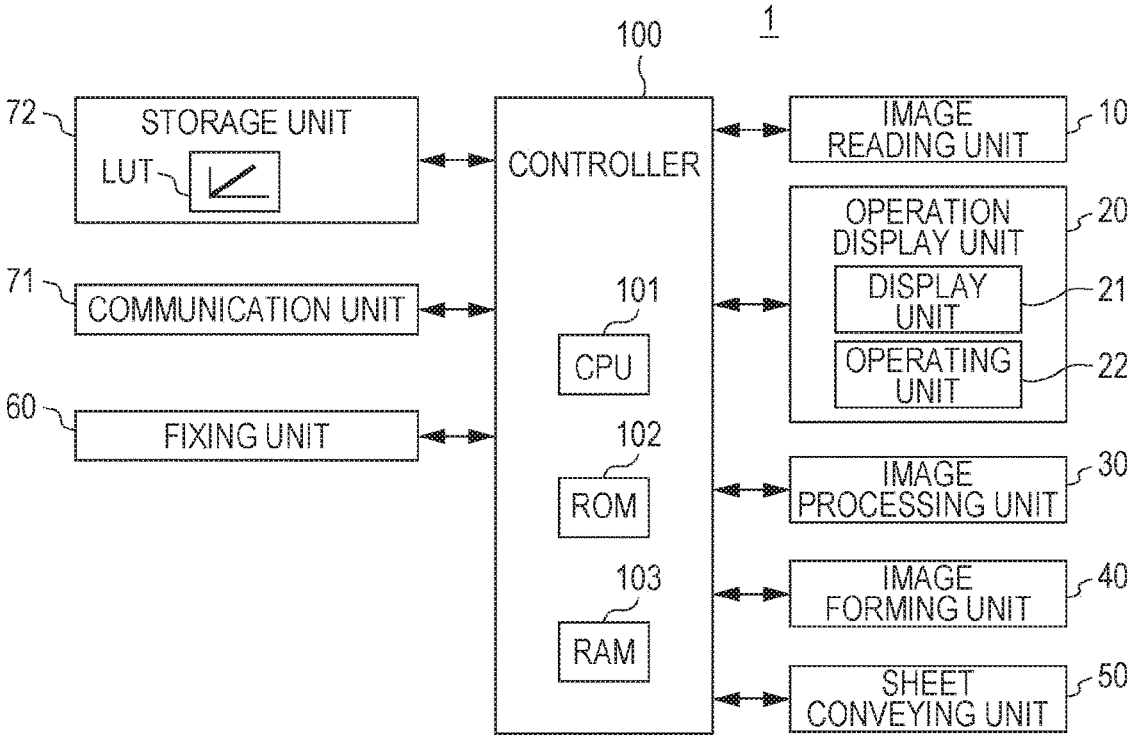
FIG. 2 is a diagram showing the principal components of the control system of the image forming apparatus according to this embodiment.

Hereinafter, one or more embodiments of the present invention will be described in detail with reference to the drawings. However, the scope of the invention is not limited to the disclosed embodiments. FIG. 1 is a diagram schematically showing the entire structure of an image forming apparatus 1 according to this embodiment. FIG. 2 is a diagram showing the principal components of the control system of the image forming apparatus 1 according to this embodiment.

As shown in FIG. 1, the image forming apparatus 1 is a color image forming apparatus of an intermediate transfer type using an electrophotographic process technology. Specifically, the image forming apparatus 1 performs a primary transfer of toner images in the respective colors of Y (yellow), M (magenta), C (cyan), and K (black) from photosensitive drums 413 onto an intermediate transfer belt 421, and overlaps the toner images in the four colors on one another on the intermediate transfer belt 421. After that, the image forming apparatus 1 performs a secondary transfer of the toner images onto a paper sheet S sent out from one of sheet feeder tray units 51*a* through 51*c*. Thus, an image is formed.

In the image forming apparatus 1, a tandem system is employed so that the photosensitive drums 413 corresponding to the four colors of YMCK are arranged in series in the conveyance direction of the intermediate transfer belt 421, and toner images in the respective colors are sequentially transferred onto the intermediate transfer belt 421 by one operation.

As shown in FIG. 2, the image forming apparatus 1 includes an image reading unit 10, an operation display unit 20, an image processing unit 30, an image forming unit 40, a sheet conveying unit 50, a fixing unit 60, and a controller 100.

The controller 100 includes a central processing unit (CPU) 101, a read only memory (ROM) 102, and a random access memory (RAM) 103. The CPU 101 reads a program in accordance with the purpose of processing from the ROM 102, and loads the program into the RAM 103. In conjunction with the loaded program, the CPU 101 controls operation of each block or the like in the image forming apparatus 1 in a centralized manner. At this point of operation, various kinds of data stored in a storage unit 72 are referred to. The storage unit 72 is formed with a nonvolatile semiconductor memory (a so-called flash memory) or a hard disk drive, for example.

The controller 100 performs transmission and reception of various kinds of data to and from an external device (a personal computer, for example) connected to a communication network such as a LAN (Local Area Network) or a WAN (Wide Area Network) via a communication unit 71. The controller 100 receives image data (input image data) transmitted from an external device, for example, and causes formation of an image on a paper sheet S in accordance with the image data. The communication unit 71 is formed with a communication control card, such as a LAN card.

As shown in FIG. 1, the image reading unit 10 is designed to include an automatic document feeding device 11 called an auto document feeder (ADF), and a document image scanning device 12 (a scanner).

The automatic document feeding device 11 conveys a document D placed on a document tray with a conveyance mechanism, to send the document D to the document image scanning device 12. By virtue of the automatic document feeding device 11, images of a large number of documents D placed on the document tray can be consecutively and collectively read.

The document image scanning device 12 optically scans a document conveyed onto a contact glass from the automatic document feeding device 11 or a document placed on the contact glass, and forms an image on the light receiving surface of a charge coupled device (CCD) sensor 12*a* with light reflected from the document. In this manner, a document image is read. The image reading unit 10 generates input image data in accordance with the results of the reading performed by the document image scanning device 12. This input image data is subjected to predetermined image processing at the image processing unit 30.

As shown in FIG. 2, the operation display unit 20 is formed with a liquid crystal display (LCD) having a touch panel, for example, and functions as a display unit 21 and an operating unit 22. The display unit 21 displays various operation screens, conditions of images, operating conditions of respective functions, and the like, in accordance with display control signals that are input from the controller 100. The operating unit 22 includes various kinds of operation keys such as a numeric keypad and a start key, to receive various input operations from users and output operating signals to the controller 100.

The image processing unit 30 includes a circuit or the like that performs digital image processing on input image data in accordance with initial settings or user settings. For example, the image processing unit 30 performs tone correction based on tone correction data (a tone correction table) under the control of the controller 100. The image processing unit 30 also performs various correction processes other than the tone correction, such as color correction and shading correction, a compression process, and the like, on the input image data. The image forming unit 40 is controlled in accordance with the image data subjected to those processes.

As shown in FIG. 1, the image forming unit 40 includes image formation units 41Y, 41M, 41C, and 41K, and an intermediate transfer unit 42. The image formation units 41Y, 41M, 41C, and 41K form images with the respective single-color toners of the Y component, the M component, the C component, and the K component, in accordance with the input image data.

The image formation units 41Y, 41M, 41C, and 41K for the Y component, the M component, the C component, and the K component each have the same structure. For ease of explanation and simplification of illustration in the drawings, like structural elements are denoted by like reference numerals, and Y, M, C, or K is attached to a reference numeral where there is a need for a distinction. In FIG. 1, only the structural elements of the image formation unit 41Y for the Y component are denoted by reference numerals, but the structural elements of the other image formation units 41M, 41C, and 41K are not.

Each image formation unit 41 includes an exposing device 411, a developing device 412, a photosensitive drum 413, a charging device 414, and a drum cleaning device 415.

The photosensitive drum 413 is formed with an organic photoreceptor in which a photosensitive layer made of a resin containing an organic photoconductor is formed on the outer peripheral surface of a drum-shaped metal substrate, for example.

The controller 100 causes the photosensitive drum 413 to rotate at a constant circumferential velocity by controlling the drive current to be supplied to the drive motor (not shown) for causing the photosensitive drum 413 to rotate.

The charging device 414 is an electric charger, for example, and generates corona discharge to negatively charge the surface of the photoconductive photosensitive drum 413 in a uniform manner.

The exposing device 411 is formed with a semiconductor laser, for example. The exposing device 411 illuminates the photosensitive drum 413 with laser light in accordance with the image of the corresponding color component. As a result, an electrostatic latent image of the corresponding color component is formed in the image area illuminated with the laser light on the surface of the photosensitive drum 413, because of a potential difference from the background area.

The developing device 412 is a developing device of a two-component reversal type. The developing device 412 applies a developer of the corresponding color component onto the surface of the photosensitive drum 413, to make the electrostatic latent image visible and form a toner image.

For example, a DC developing bias having the same polarity as the charging polarity of the charging device 414, or a developing bias in which a DC voltage having the same polarity as the charging polarity of the charging device 414 is superimposed on an AC voltage is applied to the developing device 412. As a result, reversal development for attaching toner to the electrostatic latent image formed by the exposing device 411 is performed. The developing device 412 will be described later in detail.

The drum cleaning device 415 has a plate-like drum cleaning blade or the like that is in contact with the surface of the photosensitive drum 413 and is made of an elastic material, and removes toner that has not been transferred to the intermediate transfer belt 421 but remains on the surface of the photosensitive drum 413.

The intermediate transfer unit 42 includes the intermediate transfer belt 421, primary transfer rollers 422, supporting rollers 423, a secondary transfer roller 424, and a belt cleaning device 426.

The intermediate transfer belt 421 is formed with an endless belt, and is stretched in the form of a loop by the supporting rollers 423. At least one of the supporting rollers 423 is a driving roller, and the other ones are following rollers. For example, a roller 423A that is located on the downstream side of the primary transfer roller 422 for the K component in the belt moving direction is preferably the driving roller. With this, the moving speed of the belt in the primary transfer unit can be easily maintained at a constant speed. As the driving roller 423A rotates, the intermediate transfer belt 421 moves in the direction indicated by an arrow A at a constant speed.

The intermediate transfer belt 421 is a belt having conductivity and elasticity, and has a high-resistance layer on its surface. The intermediate transfer belt 421 is rotatively driven by a control signal supplied from the controller 100.

The primary transfer rollers 422 are placed on the inner peripheral surface side of the intermediate transfer belt 421, facing the photosensitive drums 413 of the respective color components. As the primary transfer rollers 422 are pressed against the photosensitive drums 413 with the intermediate transfer belt 421 interposed in between, primary transfer nips for transferring toner images from the photosensitive drums 413 onto the intermediate transfer belt 421 are formed.

The secondary transfer roller 424 is placed on the outer peripheral surface side of the intermediate transfer belt 421, facing a back-up roller 423B placed on the downstream side of the driving roller 423A in the belt moving direction. As the secondary transfer roller 424 is pressed against the back-up roller 423B with the intermediate transfer belt 421 interposed in between, a secondary transfer nip for transferring a toner image from the intermediate transfer belt 421 onto a paper sheet S is formed.

When the intermediate transfer belt 421 passes through the primary transfer nips, the toner images on the photosensitive drums 413 are sequentially transferred onto the intermediate transfer belt 421 in an overlapping manner. Specifically, a primary transfer bias is applied to each primary transfer roller 422 to provide the back surface side of the intermediate transfer belt 421 (or the side in contact with the primary transfer rollers 422) with a charge of the opposite polarity from that of the toner. In this manner, the toner images are electrostatically transferred onto the intermediate transfer belt 421.

When a paper sheet S passes through the secondary transfer nip after that, the toner image on the intermediate transfer belt 421 is transferred onto the paper sheet S through the secondary transfer. Specifically, a secondary transfer bias is applied to the secondary transfer roller 424 to provide the back surface side of the paper sheet S, or the side of the paper sheet S in contact with the secondary transfer roller 424, with a charge of the opposite polarity from the polarity of the toner. In this manner, the toner image is electrostatically transferred onto the paper sheet S. The paper sheet S having the toner image transferred thereonto is then conveyed toward the fixing unit 60.

The belt cleaning device 426 removes the toner remaining on the surface of the intermediate transfer belt 421 after the secondary transfer.

The fixing unit 60 includes: an upper fixing unit 60A that has a fixing-surface-side member placed on the fixing surface of the paper sheet S, or on the surface on which the toner image is formed; a lower fixing unit 60B that has a back-surface-side supporting member placed on the back surface of the paper sheet S, or on the surface on the opposite side from the fixing surface; and a heating source. As the back-surface-side supporting member is pressed against the fixing-surface-side member, a fixing nip for nipping and conveying the paper sheet S is formed.

At the fixing nip, the fixing unit 60 heats and presses the paper sheet S that has the toner image transferred thereonto through the secondary transfer and has been conveyed. In this manner, the toner image is fixed to the paper sheet S. The fixing unit 60 is disposed as a unit in a fixing device F.

The upper fixing unit 60A includes an endless fixing belt 61 serving as the fixing-surface-side member, a heating roller 62, and a fixing roller 63. The fixing belt 61 is stretched by the heating roller 62 and the fixing roller 63.

The lower fixing unit 60B includes a pressure roller 64 that serves as the back-surface-side supporting member. The pressure roller 64 forms a fixing nip for nipping and conveying the paper sheet S between the pressure roller 64 and the fixing belt 61.

The sheet conveying unit 50 includes a sheet feeding unit 51, a sheet discharging unit 52, and a conveyance path unit 53. Paper sheets S (standard paper sheets or special paper sheets) sorted out in accordance with basis weights, sizes, and the like are stored on the basis of predetermined types in the three sheet feeder tray units 51*a* through 51*c* that constitute the sheet feeding unit 51. The conveyance path unit 53 includes pairs of conveyance screws including a pair of registration rollers 53*a*. A registration roller unit in which the pair of registration rollers 53*a* are disposed corrects tilts or deviations of the paper sheets S.

The paper sheets S stored in the sheet feeder tray units 51*a* through 51*c* are sent out one by one, starting from the uppermost one. The paper sheets S are conveyed to the image forming unit 40 by the conveyance path unit 53. In the image forming unit 40, the toner images on the intermediate transfer belt 421 are collectively transferred onto one of the surfaces of the paper sheet S through secondary transfer, and a fixing step is carried out in the fixing unit 60. The paper sheet S having an image formed thereon is then discharged to the outside of the apparatus by the sheet discharging unit 52 including sheet discharge rollers 52*a*.

Figure 3:
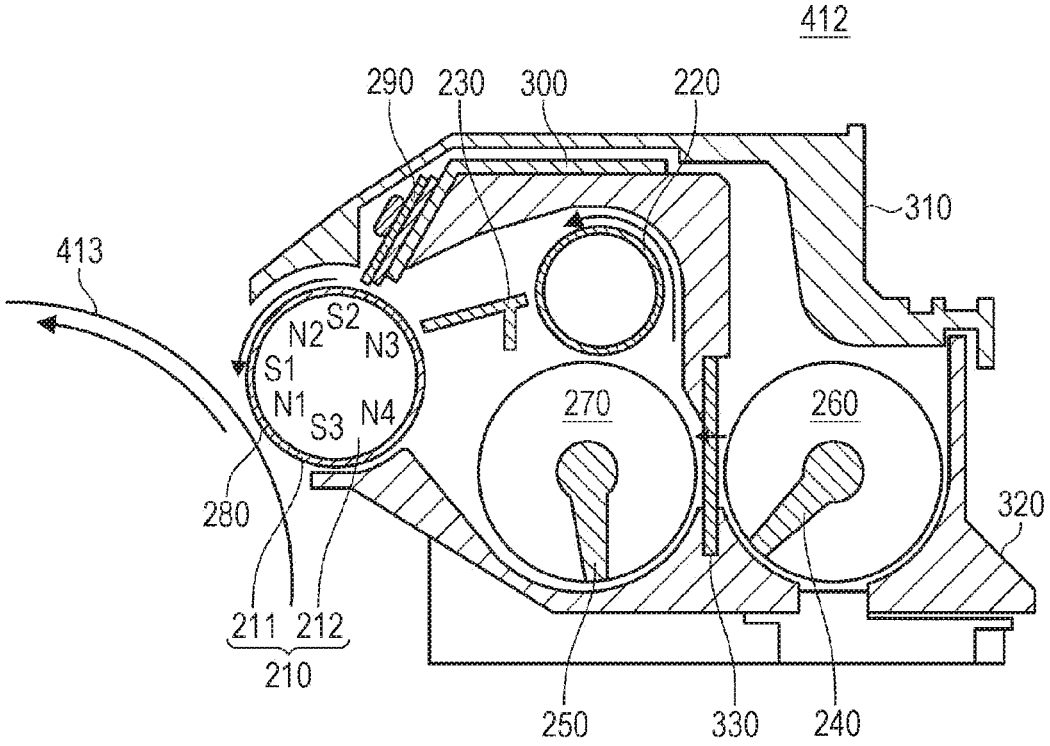
FIG. 3 is a vertical cross-sectional view showing the structure of a developing device according to this embodiment.

Referring now to FIG. 3, the structure of each developing device 412 is described. In this embodiment, a two-component developing system is adopted as each developing device 412.

The developing device 412 forms a toner image on the photosensitive drum 413 by developing an electrostatic latent image formed on the photosensitive drum 413, using a developer containing toner and a magnetic carrier. The developing device 412 includes a developing roller 210, a supply roller 220, a conveyance guide portion 230, a stirring screw 240, and a supply screw 250.

The stirring screw 240 and the supply screw 250 are helical screw members, and serve as conveyance members that perform conveyance while stirring the developer in developing tanks which will be described later. The stirring screw 240 and the supply screw 250 are housed in developer supply chambers 260 and 270, respectively. Here, the developer supply chamber 270 in which the supply screw 250 is housed serves as a first developing tank for supplying the developer to the developing roller 210. Meanwhile, the developer supply chamber 260 in which the stirring screw 240 is housed serves as a second developing tank. The stirring screw 240 and the supply screw 250 convey the developer in these developing tanks to the supply roller 220 while stirring developer. Hereinafter, the developer supply chamber 270 and the developer supply chamber 260 will be referred to as the first developing tank 270 and the second developing tank 260, respectively. A connecting path for circulating the developer between the first developing tank 270 and the second developing tank 260 is formed between the first developing tank 270 and the second developing tank 260, and this structure will be described later.

The supply roller 220 includes a rotatable supply sleeve and a supply magnet roll disposed inside the supply sleeve, and is disposed to face the supply screw 250. In the supply magnet roll, magnetic poles (five magnetic poles, for example) for generating a magnetic field are formed. By virtue of the magnetic field generated by the magnetic poles, the developer is carried on the outer peripheral surface of the supply sleeve, and is conveyed to the conveyance guide portion 230 as the supply sleeve rotates counterclockwise in the drawing. More specifically, the magnetic poles in the supply magnet roll include a catch pole (a north pole, for example) that serves to catch the developer, and a release pole (a south pole, for example) that remove the developer from the supply roller 220 and delivers the developer to the developing roller 210. The catch pole is normally disposed at a position close to the supply screw 250 and the first developing tank 270.

The conveyance guide portion 230 is set between the developing roller 210 and the supply roller 220, and supplies the developer conveyed from the supply roller 220 to the developing roller 210. The upper surface of the conveyance guide portion 230 is a flat surface, and forms a downward slope from the supply roller 220 to the developing roller 210. A predetermined space (0.75 mm, for example) is formed between the supply roller 220 and the edge portion of the conveyance guide portion 230 on the side of the supply roller 220.

The developing roller 210 includes a rotatable developing sleeve 211 and a developing magnet roll 212 disposed inside the developing sleeve 211. The developing roller 210 is disposed close to the photosensitive drum 413, and transports the developer to a developing region 280 adjacent to the photosensitive drum 413. The developing sleeve 211 rotates counterclockwise in FIG. 3. In the developing magnet roll 212, magnetic poles for generating a magnetic field are formed. A predetermined space (0.50 mm, for example) is formed between the developing sleeve 211 and the edge portion of the conveyance guide portion 230 on the side of the developing roller 210.

A regulating blade 290 is disposed in the vicinity of the developing sleeve 211. The edge portion of the regulating blade 290 is located on the downstream side of the portion near the conveyance guide portion 230 in the direction of rotation of the developing sleeve 211 and on the upstream side of the developing region 280. The regulating blade 290 is supported by a regulating holder 300.

Part of the developing roller 210, the supply roller 220, the conveyance guide portion 230, the stirring screw 240, the supply screw 250, and the regulating blade 290 are housed in a developing casing (310, 320). The developing casing is formed with an upper casing 310 and a lower casing 320. The lower casing 320 forms the first developing tank 270 and the second developing tank 260. The first developing tank 270 and the second developing tank 260 are partitioned by a partition wall 330. The regulating holder 300 that supports the regulating blade 290 is secured to the inner ceiling portion of the upper casing 310.

The second developing tank 260 is connected to a replenishing port 311 (see FIG. 4) on the upstream side in the developer conveying direction. A developer containing toner and carrier is supplied into the second developing tank 260 from a developer supply unit (not shown) through the replenishing port 311. The stirring screw 240 rotates to mix and stir the toner and the carrier supplied into the second developing tank 260, and thus, frictionally charge the toner and the carrier. The stirring screw 240 conveys the frictionally charged developer to the first developing tank 270. The supply screw 250 rotates to convey the developer transported from the stirring screw 240 to the supply roller 220.

A magnetic brush of the carrier is generated on the outer peripheral surface of the supply sleeve by the magnetic field generated by the supply magnet roll of the supply roller 220, and a layer of the developer including the toner carried by the magnetic brush is formed on the outer peripheral surface of the supply sleeve. As shown in FIG. 3, the supply sleeve rotates counterclockwise, to convey the developer to the conveyance guide portion 230 while carrying the developer on the outer peripheral surface of the supply sleeve with a magnetic field.

The developer on the conveyance guide portion 230 is guided to the developing roller 210. By virtue of the magnetic field generated by the developing magnet roll 212, a magnetic brush is generated on the outer peripheral surface of the developing sleeve 211, and a layer of the developer is formed on the outer peripheral surface of the developing sleeve 211. The developing sleeve 211 rotates counterclockwise in the drawing, to convey the developer to the developing region 280, which is the closest to the photosensitive drum 413, while carrying the developer on the outer peripheral surface of the developing sleeve 211 with the magnetic field. In the course of this process, the regulating blade 290 regulates the thickness of the layer of the developer, so that a certain amount of the developer is conveyed to the developing region 280. In the developing region 280, the layer of the developer comes into contact with the surface of the photosensitive drum 413. In the developing region 280, the toner electrostatically moves from the developing sleeve 211 to an electrostatic latent image formed on the surface of the photosensitive drum 413. In this manner, the developing device 412 visualizes the electrostatic latent image on the photosensitive drum 413 with the toner.

Next, the connecting path between the first developing tank 270 and the second developing tank 260, the flow of the developer in the developing device 412, and the like are described with reference to FIG. 4 and other drawings. For simplification, the stirring screw 240, the supply screw 250 and the like are not shown in FIG. 4.

Figure 4:
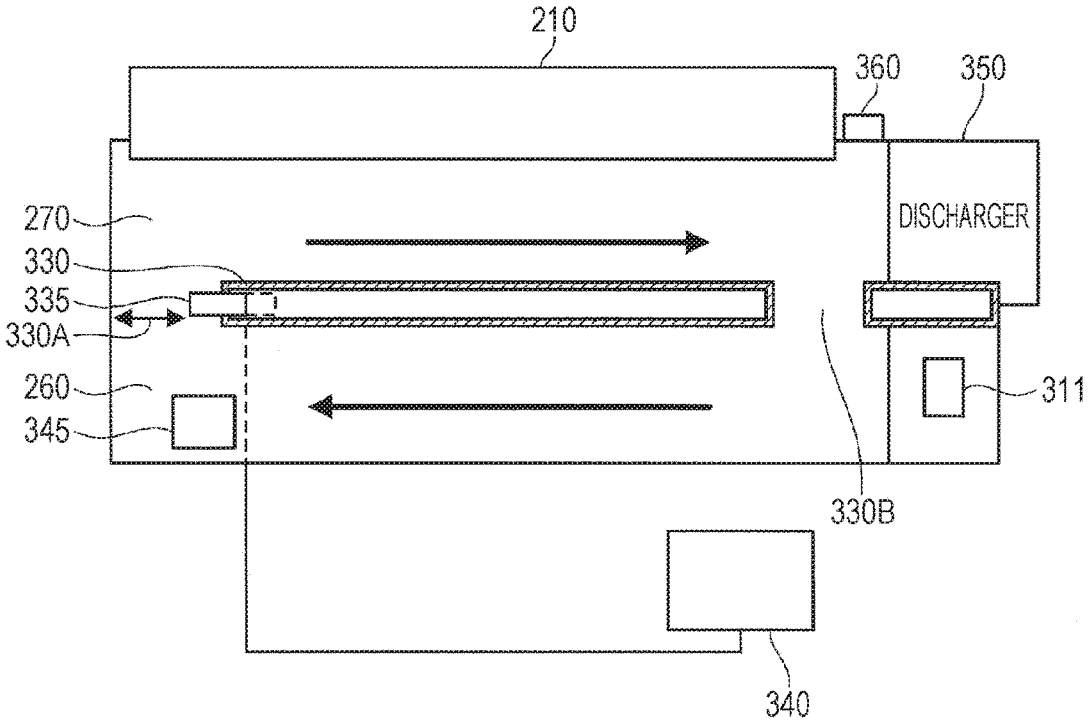
FIG. 4 is a plan view showing the flow of the developer in the developing device of this embodiment.

As shown in FIG. 4, in the developing device 412 of this embodiment, there are spaces on both the right and left end sides of the partition wall 330 that separates the first developing tank 270 and the second developing tank 260 from each other, and these spaces form the connecting path for connecting the first developing tank 270 and the second developing tank 260. By virtue of this connecting path, the developer in the developing tanks (260 and 270) is conveyed so as to circulate clockwise (see arrows) in FIG. 4.

More specifically, a connecting part 330A that defines the width of the outlet of the second developing tank 260 and the inlet (an upstream-side path) of the first developing tank 270 is formed on the left end side of the partition wall 330. The right end side of the partition wall 330 is provided with a connecting part 330B that forms a downstream-side path for returning the developer from the downstream side of the first developing tank 270 to the upstream side of the second developing tank 260. With these connecting parts 330A and 330B, the developer supplied into the second developing tank 260 is supplied from the first developing tank 270 to the supply roller 220 through the connecting part 330A, and part of the remaining developers move (circulate) to return to the second developing tank 260 through the connecting part 330B. The remaining part of the developer is discharged from a discharger 350 that will be described later, and this aspect will be also described later.

Further, on the left end side of the partition wall 330, a partition member 335 is provided so as to be able to reciprocate in the width direction of the partition wall 330. The partition member 335 defines the size (width) of the connecting path at the connecting part 330A from the downstream (outlet) side of the second developing tank 260 to the upstream (inlet) side of the first developing tank 270. The partition member 335 is connected to a solenoid 340. As a drive signal is supplied from a hardware processor, i.e., the CPU 101 in the controller 100, to the solenoid 340, the partition member 335 moves in the direction indicated by a double-headed arrow in FIG. 4, and thus changes the connecting width of the connecting part 330A.

In another example, the partition member 335 may be provided on the right end side of the partition wall 330, and change the connecting width of the connecting part 330B. Meanwhile, a bulk detection sensor 360 that will be described later is located on the right end side of the partition wall 330. Therefore, to more accurately obtain the discharge amount of the developer from a detection signal supplied from the bulk detection sensor 360, it is desirable to provide the partition member 335 on the left end side of the partition wall 330, which is the opposite side from the bulk detection sensor 360, as in this embodiment.

A toner-carrier ratio (TCR) sensor 345 that detects the magnetic permeability of the developer for toner concentration control is disposed on the downstream side of the second developing tank 260. The bulk detection sensor 360 for detecting the bulkiness of the developer in the first developing tank 270 is disposed on the downstream side of the first developing tank 270. The bulk detection sensor 360 detects the bulk of the developer in the first developing tank 270 by measuring the magnetic permeability of the developer in the first developing tank 270.

Another example of the bulk detection sensor 360 may measure the bulkiness of the developer in the first developing tank 270 using an optical technique such as an optical sensor, or through physical contact. In general, the bulk detection sensor 360 may be any sensor that can measure the bulkiness of the developer in the first developing tank 270.

Figure 5:
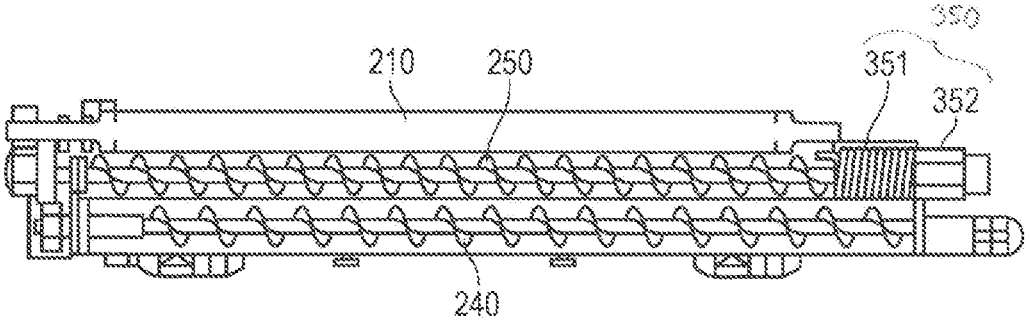
FIG. 5 is a plan view for explaining the structure of a developer discharger of the developing device in this embodiment.

Further, the discharger 350 for discharging part of the developer to the outside of the developing device 412 is provided on the downstream side of the first developing tank 270. As shown in FIG. 5, the discharger 350 includes a reverse winding screw 351 connected to the supply screw 250, and a discharge port 352 through which the developer from the downstream side of the first developing tank 270 is discharged. In this developing device 412, the stirring screw 240, the supply screw 250, and the reverse winding screw 351 are rotated in conjunction with one another by a single drive source.

In the developing device 412 having such a structure, the developer is supplied from the replenishing port 311, and flows into the second developing tank 260. As the stirring screw 240 rotates, the developer flows from the second developing tank 260 to the first developing tank 270 via the connecting part 330A, as indicated by an arrow in FIG. 4. At this stage, it is possible to adjust the amount of the developer flowing into the first developing tank 270 by controlling the position of the partition member 335. Also, as the supply screw 250 rotates, most of the developer in the first developing tank 270 is supplied to the developing roller 210, and part of the developer is returned from the connecting park 330B to the second developing tank 260 while the remaining part of the developer reaches the discharger 350. The developer that has reached the discharger 350 is discharged from the discharger 350 to the outside of the developing device 412 by rotation of the reverse winding screw 351. Accordingly, the partition member 335 or the supply screw 250 can be used as a developer amount adjuster in that a position of the partition member 335 and a speed of the supply screw 250 adjusts an amount of the developer in the developing tank 270.

Thus, in the developing device 412, the second developing tank 260 is replenished with a new developer through the replenishing port 311, and part of the developer contained in the developing device 412 is discharged to the outside of the device from the discharge port 352. In this manner, the amount of degraded carrier in the developing device 412 is reduced, and the amount and the charging ability of the carrier contained in the developing device 412 are maintained. With the image forming apparatus 1 using such a trickle development method, it is possible to achieve stable output image quality.

In the developing device 412 adopting the trickle development method as in this embodiment, however, the amount of the developer in the developing device 412 greatly fluctuates depending on coverage, environmental temperature and humidity, the installation state of the device, and the like. Where the amount of the developer greatly fluctuates, the toner concentration in the developer is not stabilized, resulting in image defects such as fogging and image density fluctuation.

Further, with the trickle development method, there is a problem that the necessary amount of the developer cannot be supplied to the developing roller, and image unevenness is easily caused, due to fluctuations of the amount of the developer in the developing device 412. Particularly, in small-sized developing devices and developing devices to be driven at high speed in the field of production printing, it is difficult to stabilize the amount of the developer in a developing device, and the above problems are easily caused.

To solve the above problem in a conventional case, a sensor or the like for detecting the amount and the bulk of the developer is provided in the developing device 412, and, if the amount or the bulk of the developer deviates from a predetermined range, control is performed to change the numbers of revolutions of the respective screws (240, 250, and 351), for example.

In a case where such control is performed, however, there is a problem that supposedly allowable fluctuations of the amount (bulk) of the developer are also subjected to the control. For example, at the time of high-coverage printing, the bulk of the developer increases, and the discharge amount of the developer increases. However, the amount of the supplied developer also increases, so that balance is maintained in the total developer amount. Therefore, if the control to change the numbers of revolutions of the stirring screw 240 and the supply screw 250 is immediately performed after the bulk of the developer fluctuates, there is a possibility that the mixing and stirring and the toner concentration control at the time of toner replenishment are not performed in a preferred manner.

In a conventional developing device and a conventional image forming apparatus, the optimal amount of the developer in the developing unit is not sufficiently taken into consideration from the viewpoint of the supply amount and the discharge amount of the developer, and it is generally considered that there was only insufficient knowledge as to suitable states in which the control should be performed to return the bulkiness of the developer to the reference level. Further, to cope with various circumstances, it is also critical to prepare two or more means to change the amount of the developer in the developing unit, and perform control to actively reduce fluctuations of the bulk of the developer while maximizing the performance the developing unit should show.

Therefore, in this embodiment based on the findings described below, the partition member 335 or the variable width connecting part 330A and the screws (240, 250, and 351) whose rotation speeds are variable are provided as two kinds of means to change the amount of the developer in the developing device 412, and control is performed so that these two kinds of means are selectively used in accordance with situations.

The findings of the present inventors are described below. To keep the amount of the developer in the developing device 412 within a certain range and maintain high printed image quality, it is critical to constantly monitor and collate the supply amount and the discharge amount of the developer, and determine whether these amounts are changing within expected ranges (or are kept in balance or the like), and whether appropriate operation is being performed. It is important to frequently or constantly make such determination. As a result of such monitoring and determination, the means to change the amount of the developer is preferably selected, and the amount of the developer in the developing device 412 is preferably controlled, in accordance with a situation where the balance between the supply amount and the discharge amount of the developer is undesirable, there is some abnormality, there is an emergency, or the like.

Further, in the developing device 412 of this embodiment, the developing tank is divided into the first developing tank 270 and the second developing tank 260. Therefore, even if the amount of the developer in the developing device 412 is constant, various problems might be caused in a case where the bulkiness of the developer in the first developing tank 270 is not kept within a certain range. Specifically, when the bulkiness of the developer in the first developing tank 270 becomes lower than the lower limit value, image defects such as density unevenness in a printed image are likely to occur. When the bulkiness becomes higher than the upper limit value, spilling or scattering of the developer is liable to occur. Therefore, in the developing device 412, the position of the partition member 335 or the rotation speeds of the respective screws (240, 250, and 351) need to be adjusted to keep the bulkiness of the developer in the first developing tank 270 within a certain range, and prevent the bulkiness from becoming lower than the lower limit value or becoming higher than the upper limit value.

In view of these findings, in this embodiment, the controller 100 monitors and collates the supply amount of the developer and the discharge amount of the developer obtained from coverage information and a toner replenishment amount, constantly or at short intervals (every few seconds, for example) during print job execution. Here, the developer discharge amount can be obtained from a result of detection performed by the bulk detection sensor 360 that detects the bulkiness (water level) of the developer in the first developing tank 270.

Through such monitoring and collation, the controller 100 determines whether an abnormality has occurred. If an abnormality is detected, the controller 100 adjusts the position of the partition member 335. In this case, the introduction properties of the developer from the second developing tank 260 to the first developing tank 270 change. Therefore, the bulkiness of the developer in the first developing tank 270 can be promptly changed, but the discharge properties of the developer through the discharge port 352 (in other words, the total amount of the developer in the developing device 412) do not change greatly.

In a case where the abnormality is not eliminated even after the position of the partition member 335 is adjusted (a case where the bulkiness (water level) of the developer in the first developing tank 270 does not return to a value within a certain range), the controller 100 determines that there is an emergency, and adjusts the rotation speeds of the respective screws (240, 250, and 351). If the adjustment amounts (fluctuations) of the rotation speeds are large, the fluctuation of the moving speed of the developer between the second developing tank 260 and the first developing tank 270 is large, and therefore, the bulkiness of the developer in the first developing tank 270 can be changed more promptly. If the adjustment amounts (fluctuations) of the rotation speeds are large, the discharge properties of the developer through the discharge port 352 or the developer amount in the developing device 412 also greatly fluctuates.

According to this embodiment for performing such control, it is possible to reduce fluctuations of the amount the developer in the developing device 412 while maintaining the highest possible printed image quality.

In the description below, the structures relating to the control on the developer amount are explained.

Figure 6A:
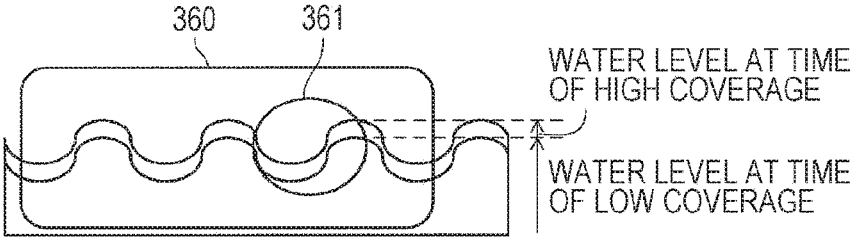
FIGS. 6A and 6B are diagrams for explaining water levels of the developer in the developing device, the functions of a bulk detection sensor, and the like, FIG. 6A is a diagram showing water levels in a normal range.
Figure 6B:
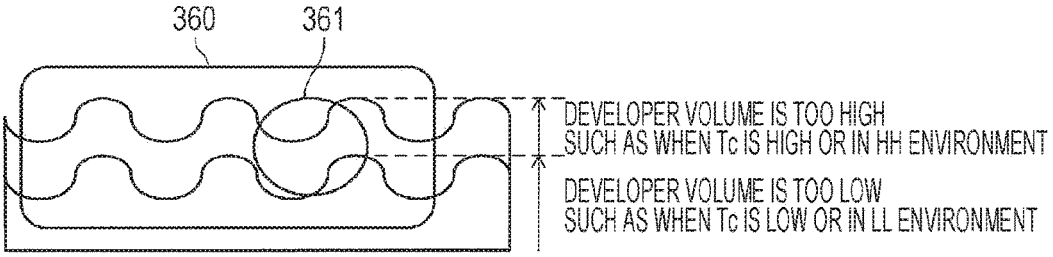

FIGS. 6A and 6B are diagrams for explaining the bulkiness of the developer in the first developing tank 270 of the developing device 412 (hereinafter, the bulkiness of the developer will also be referred to as the "water level" for convenience), the functions of the bulk detection sensor 360, and the like. FIG. 6A shows the water levels in a normal range. FIG. 6B shows the water levels outside the normal range. As shown in FIG. 6A, in a normal state, the difference in the water level of the developer between a high-coverage operation and a low-coverage operation is relatively small. On the other hand, FIG. 6B shows a case where the water level of the developer greatly fluctuates due to some trouble.

As can be seen from comparison with FIG. 6A, in the example shown in FIG. 6B, the water level of the developer greatly deviates from the normal range. The example shown in FIG. 6B is likely to occur in a case where the toner concentration is high or in an HH environment. Specifically, in a case where the toner concentration is high during printing or in an HH environment, the bulk of the developer tends to be higher than that in a normal high-coverage operation (see FIG. 6A). Conversely, in a case where the toner concentration is low or in an LL environment, the bulk of the developer tends to be lower than that in a normal low-coverage operation (see FIG. 6A).

Furthermore, in a case where the installation state of the image forming apparatus 1 is poor, or where the bottom surfaces of the developing tanks (260 and 270) are tilted, the bulk of the developer easily deviates greatly from the normal range.

In this embodiment, the position of the detection surface 361 of the bulk detection sensor 360 is set so that the bulk of the developer in the first developing tank 270 can be detected even in a case where the water level is outside such a normal range.

Also, in this embodiment, the discharge properties of the developer greatly change with the bulkiness of the developer to be brought into contact with the reverse winding screw 351 of the discharger 350 from the supply screw 250 of the first developing tank 270. Therefore, in this embodiment, the bulk detection sensor 360 is disposed at the most downstream side of the first developing tank 270, or is located immediately before the discharger 350 in the moving direction of the developer or near the front side of the discharge port 352. With this arrangement, it is possible to more accurately measure (calculate) the amount of the developer discharged from the discharge port 352 per unit time, using the bulk detection sensor 360.

Figure 7A:
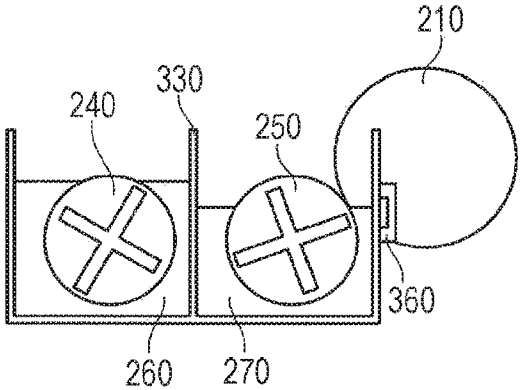
FIGS. 7A through 7C are cross-sectional views for explaining bulkiness (water levels) of the developer in the developing device in this embodiment.
Figure 7B:
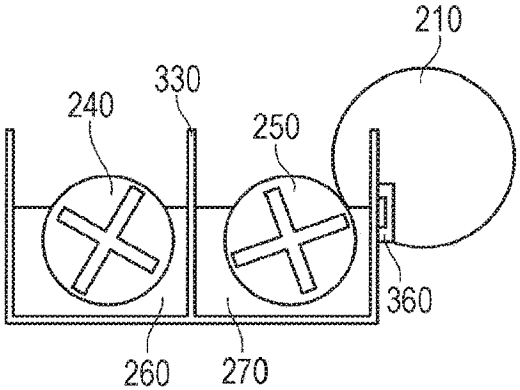
Figure 7C:
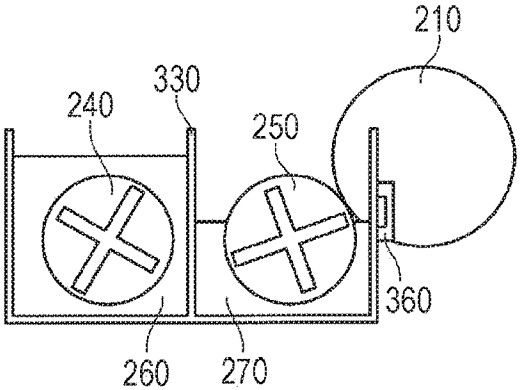

Next, the relationship between the water level of the developer in the first developing tank 270 and the water level of the developer in the second developing tank 260 is described with reference to FIGS. 7A through 7C. FIG. 7A shows an example of water levels in the normal range. FIG. 7B shows an example of water levels of the developer in a case where the connecting width of the connecting part 330A is increased. FIG. 7C shows an example of water levels of the developer in a case where the connecting width of the connecting part 330A is reduced. In the examples shown in FIGS. 7A, 7B, and 7C, it is assumed that the amount of the developer in the developing device 412 is the same.

As shown in FIG. 7A, even in a normal state during print job execution, or in a normal operation, the bulk of the developer may be different between the first developing tank 270 and the second developing tank 260 in the developing device 412. In the example shown in the drawing, the bulk of the developer in the second developing tank 260 is slightly higher than that in the first developing tank 270. If the connecting width of the connecting part 330A is increased from the connecting width in the state shown in FIG. 7A, the amount of the developer to be supplied to the first developing tank 270 gradually increases during printing, and, as shown in FIG. 7B, the bulk of the developer can be made substantially the same between the first developing tank 270 and the second developing tank 260. If the connecting width of the connecting part 330A is reduced from the connecting width in the state shown in FIG. 7A, on the other hand, the amount of the developer to be supplied to the first developing tank 270 gradually decreases during printing, and, as shown in FIG. 7C, the bulk of the developer in the first developing tank 270 becomes even lower.

In one example, the standard bulkiness (default value) of the developer in the first developing tank 270 in the normal state shown in FIG. 7A is set at 20 mm from the bottom surface of the first developing tank 270, and the lower limit value and the upper limit value are set at 15 mm and 25 mm, respectively, from the bottom surface of the first developing tank 270. On the other hand, in a case where the standard width (default value) of the connecting part 330A is set at 40 mm, and the bulkiness of the developer becomes lower than the lower limit value or higher than the upper limit value, the partition member 335 is moved in the range of 10 mm in the horizontal direction.

Specifically, the controller 100 monitors detection signals from the bulk detection sensor 360. In a case where the bulkiness of the developer in the first developing tank 270 becomes lower than 15 mm (the lower limit value), there is a possibility of an image defect. Therefore, the controller 100 causes the partition member 335 to move 10 mm to the left in FIG. 4, so that the width of the connecting part 330A is increased to 50 mm. In a case where the bulkiness of the developer in the first developing tank 270 becomes higher than 25 mm (the upper limit value), the controller 100 causes the partition member 335 to move 10 mm to the right in FIG. 4, so that the width of the connecting part 330A is reduced to 30 mm.

As the width (size) of the connecting part 330A is changed in this manner, the amount of the developer flowing into the first developing tank 270 from the second developing tank 260 per unit time increases or decreases, and as a result, the bulkiness of the developer can be returned to 20 mm (the default value) from the bottom surface of the first developing tank 270.

Another example measure for returning the bulkiness to the default value in a case where the bulkiness of the developer becomes lower than the lower limit value or higher than the upper limit value may be to change the rotation speeds of the respective screws (240, 250, and 351) described above. Specifically, in a case where the bulkiness of the developer in the first developing tank 270 becomes lower than 15 mm (the lower limit value), the controller 100 performs control so that the rotation speed of each of these screws (240, 250, and 351) becomes lower than the standard value (the default value). In this case, the moving speed of the developer in the second developing tank 260 and the first developing tank 270 becomes lower, and the amount of the developer to be discharged to the outside from the discharge port 352 per unit time decreases. Meanwhile, the supply amount of the developer per unit time does not change, and accordingly, the bulkiness of the developer increases.

Further, in a case where the bulkiness of the developer in the first developing tank 270 becomes higher than 25 mm (the upper limit value), the controller 100 performs control so that the rotation speed of each of these screws (240, 250, and 351) becomes higher than the standard value (the default value). In this case, the moving speed of the developer in the second developing tank 260 and the first developing tank 270 becomes higher, and the amount of the developer to be discharged to the outside from the discharge port 352 per unit time increases. Meanwhile, the supply amount of the developer per unit time does not change, and accordingly, the bulkiness of the developer decreases.

Accordingly, in a case where the rotation speeds of the respective screws (240, 250, and 351) are changed, the amount of the developer flowing into the first developing tank 270 from the second developing tank 260 per unit time also increases or decreases, and as a result, the bulkiness of the developer can be returned to 20 mm (the default value) from the bottom surface of the first developing tank 270.

However, as described above, changing the rotation speeds of the respective screws (240, 250, and 351) greatly affects the mixing and stirring of the developer and the toner concentration control, and should not be frequently performed. Therefore, in this embodiment, as the measure for adjusting the bulkiness of the developer, a method of changing the width (size) of the connecting part 330A is first used, and, if the bulkiness cannot be adjusted by this method, a method of changing the rotation speeds of the respective screws (240, 250, and 351) is used.

Figure 8:
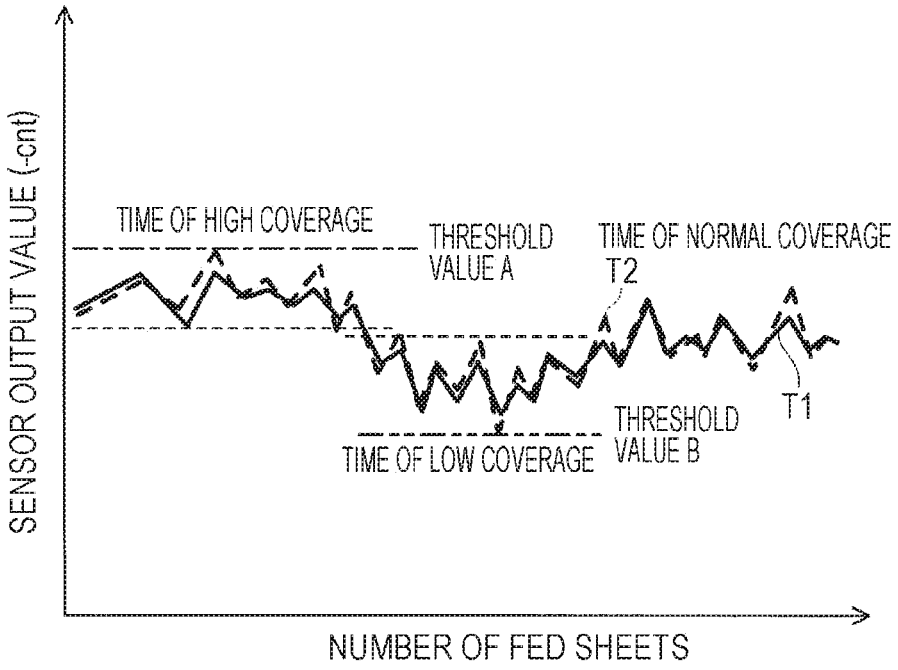
FIG. 8 is a chart in a normal state (during a normal operation) showing an example in which the water level of the developer in the developing device fluctuates when coverage fluctuations occur during printing on paper sheets.
Figure 9:
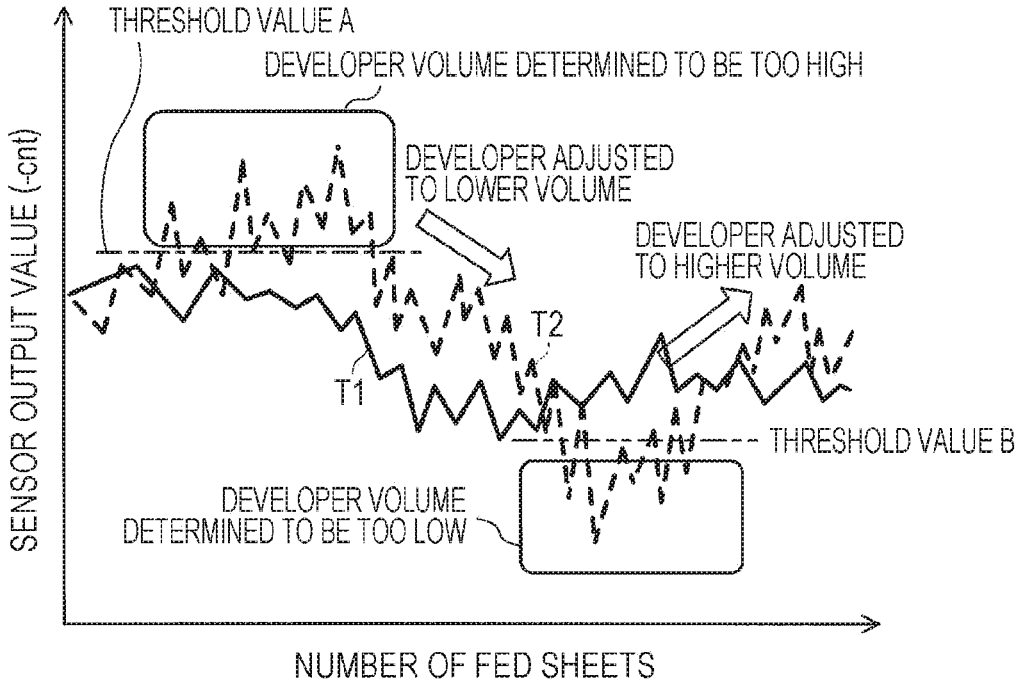
FIG. 9 is a chart in an unusual state showing an example in which the water level of the developer in the developing device fluctuates when coverage fluctuations occur during printing on paper sheets.
Figure 10:
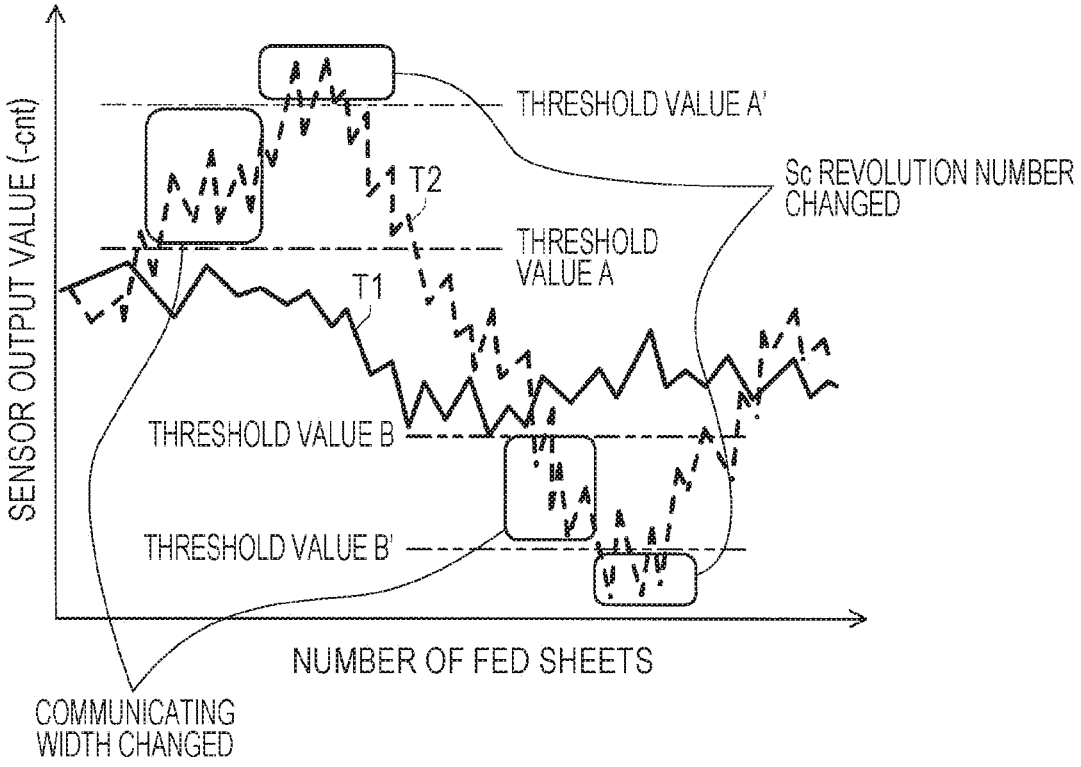
FIG. 10 is a chart in an unusual state showing an example in which the water level of the developer in the developing device fluctuates when coverage fluctuations occur during printing on paper sheets.

Next, examples in which the bulkiness of the developer in the first developing tank 270 changes or varies in a case where a coverage fluctuation occurs during printing on paper sheets are described with reference to the charts shown in FIGS. 8 through 10. FIG. 8 shows an example of a state transition in a normal state (during a normal operation). FIGS. 9 and 10 each show an example of a state transition outside the normal range (when an abnormality occurs).

In each of the charts (transition diagrams) shown in FIGS. 8 through 10, the abscissa axis indicates the number of fed paper sheets, and the ordinate axis indicates the output value (the reciprocal of a detected magnetic permeability) of the bulk detection sensor 360. Where this output value is higher, the bulk of the developer in the first developing tank 270 is higher. A trajectory T1 in each chart corresponds to the supply amount of the developer introduced (supplied) from the replenishing port 311 to the second developing tank 260, and a trajectory T2 corresponds to the discharge amount of the developer discharged from the discharge port 352. Further, threshold values A and B correspond to the upper limit value (25 mm) and the lower limit value (15 mm) of the developer water level from the bottom surface of the first developing tank 270 described above.

The example shown in FIG. 8 is a chart in a case where printing with high coverage is performed at the initial stage after the start of printing, printing with low coverage is then performed, and printing with normal coverage is performed at last. In this example, the trajectories T1 and T2 change as indicated by substantially the same polygonal lines and values (bulkiness values), regardless of coverage fluctuations.

At the time of high coverage, a large amount of the developer is supplied into the first developing tank 270. As a result, the bulk of the developer temporarily rises close to the threshold value A on the upper limit side. However, balance is maintained between the supply and the discharge of the developer during the normal operation, and therefore, the bulk of the developer does not become higher than the threshold value A. Likewise, at the time of low coverage, the supply amount of the developer decreases. As a result, the bulk of the developer temporarily drops close to the threshold value B on the lower limit side. However, balance is maintained between the supply and the discharge of the developer during the normal operation, and therefore, the bulk of the developer does not become lower than the threshold value B.

It should be noted that the example shown in FIG. 8 is based on an ideal state among normal operations. In practice, there are cases where there is a certain difference between the trajectories T1 and T2, or where the trajectories T1 and T2 do not change along the same polygonal lines as each other (see FIG. 9 and others). Even in such cases, there is no problem with usage, as long as the trajectory T2 changes within the range from the predetermined threshold value A to the predetermined threshold value B.

In this embodiment, the controller 100 detects the bulk of the developer in the first developing tank 270 from a signal output from the bulk detection sensor 360, and, at the same time, detects coverage information about the paper sheet S on which printing is currently being performed and replenishment information about the developer (toner) in real time. By doing so, the controller 100 determines whether a normal operation is being performed.

In the example shown in FIG. 9, the trajectory T1 corresponding to the supply amount of the developer is the same as that in the example case shown in FIG. 8, but the trajectory T2 corresponding to the discharge amount of the developer greatly differs from the trajectory T1. In the example shown in FIG. 9, the value output from the bulk detection sensor 360 becomes higher than the threshold value A at the time of high coverage, and the value output from the bulk detection sensor 360 becomes lower than the threshold value B at the time of low coverage.

In a case where the value output from the bulk detection sensor 360 becomes higher than the threshold value A, the controller 100 determines that an abnormality has occurred because the bulk of the developer is too high (the water level exceeds 25 mm, for example), and then performs control to reduce the developer to be supplied to the first developing tank 270. Specifically, the controller 100 outputs a control signal to the solenoid 340 so that the partition member 335 moves to reduce the width of the connecting part 330A to a smaller width than that in the normal state.

In a case where the value output from the bulk detection sensor 360 becomes lower than the threshold value B, on the other hand, the controller 100 determines that an abnormality has occurred because the bulk of the developer is too low (the water level is lower than 15 mm, for example), and then performs control to increase the developer to be supplied to the first developing tank 270. Specifically, the controller 100 outputs a control signal to the solenoid 340 so that the partition member 335 moves to increase the width of the connecting part 330A to a greater width than that in the normal state.

Other than the above, there are cases where the balance between the supply amount and the discharge amount of the developer is disrupted by some abnormality such as tilting in the installation state of the image forming apparatus 1, for example, even though neither a high-coverage operation nor a low-coverage operation is performed. With such cases being taken into consideration, the controller 100 may constantly monitor the supply amount (the trajectory T1) and the discharge amount (the trajectory T2) of the developer at the time of execution of a print job. In a case where the degree of mismatch between the transitions (the shapes of polygonal lines or the like) between the trajectories T1 and T2 is high, or where the difference between the trajectories T1 and T2 is larger than a predetermined value, the controller 100 may perform control to adjust the bulkiness of the developer in the first developing tank 270 by adjusting the width of the connecting part 330A.

In the above described example case shown FIG. 9, by adjusting the width of the connecting part 330A, it is possible to return the bulkiness of the developer in the first developing tank 270 at the time of an abnormality to a value within the range from the threshold value A to the threshold value B. Meanwhile, depending on various conditions such as environmental loads like temperature and humidity, a toner concentration load, and the installation state of the device, there are cases where the bulkiness of the developer in the first developing tank 270 cannot be returned to a value within the range from the threshold value A to the threshold value B, even though the width of the connecting part 330A has been changed. If this state continues for a certain period of time or longer, there is a possibility of spilling or scattering of the developer in a case where the bulk is too high, and there is a possibility of uneven concentration or the like in a case where the bulk is too low. Further, as shown in FIG. 10, there are cases where the value output from the bulk detection sensor 360 is higher than a threshold value A' (a developer water level of 30 mm, for example) that is higher than the threshold value A, or where the value output from the bulk detection sensor 360 is lower than a threshold value B' (a developer water level of 10 mm, for example) that is lower than the threshold value B.

In such a case, any substantial effect cannot be expected from the above described adjustment of the width of the connecting part 330A, a method of changing the number of revolutions of each of the screws (240, 250, and 351) is used as a second measure that has a higher degree of influence on the discharge properties of the developer.

As described above, the method of changing the rotation speeds of the respective screws (240, 250, and 351) to adjust the bulkiness of the developer should not be frequently used, because the speed of conveyance of the developer (or the amount of supply of the developer to the supply roller 220) is changed, and the degree of influence of the method on the mixing and stirring of the developer and the toner concentration control is high. Meanwhile, in a situation where the bulk of the developer in the first developing tank 270 is liable to suddenly drop, or in a situation where urgent countermeasures are required, changing the numbers of revolutions of the stirring screw 240 and the other screws may be prioritized over the adjustment of the width of the connecting part 330A. Examples of such situations include a time of returning from print suspension at high temperature and high humidity (HH), a time of continuous printing at extremely high coverage common in the Indian market or the like, and a time of intermittent printing in roll-to-roll (RtoR) printing. In such a case, the speed at which a signal output from the bulk detection sensor 360 quickly becomes higher than the threshold value A or lower than the threshold value B. Therefore, the controller 100 changes the speed of conveyance of the developer by changing the numbers of revolutions of the respective screws (240, 250, and 351) prior to the adjustment of the width of the connecting part 330A. That is, the controller 100 determines whether to prioritize the change of the rotation speeds of the screws (240, 250, and 351) over the adjustment of the width of the connecting part 330A, in accordance with the speed at which the value detected by the bulk detection sensor 360 becomes higher than the threshold value A or lower than the threshold value B.

Figure 11:
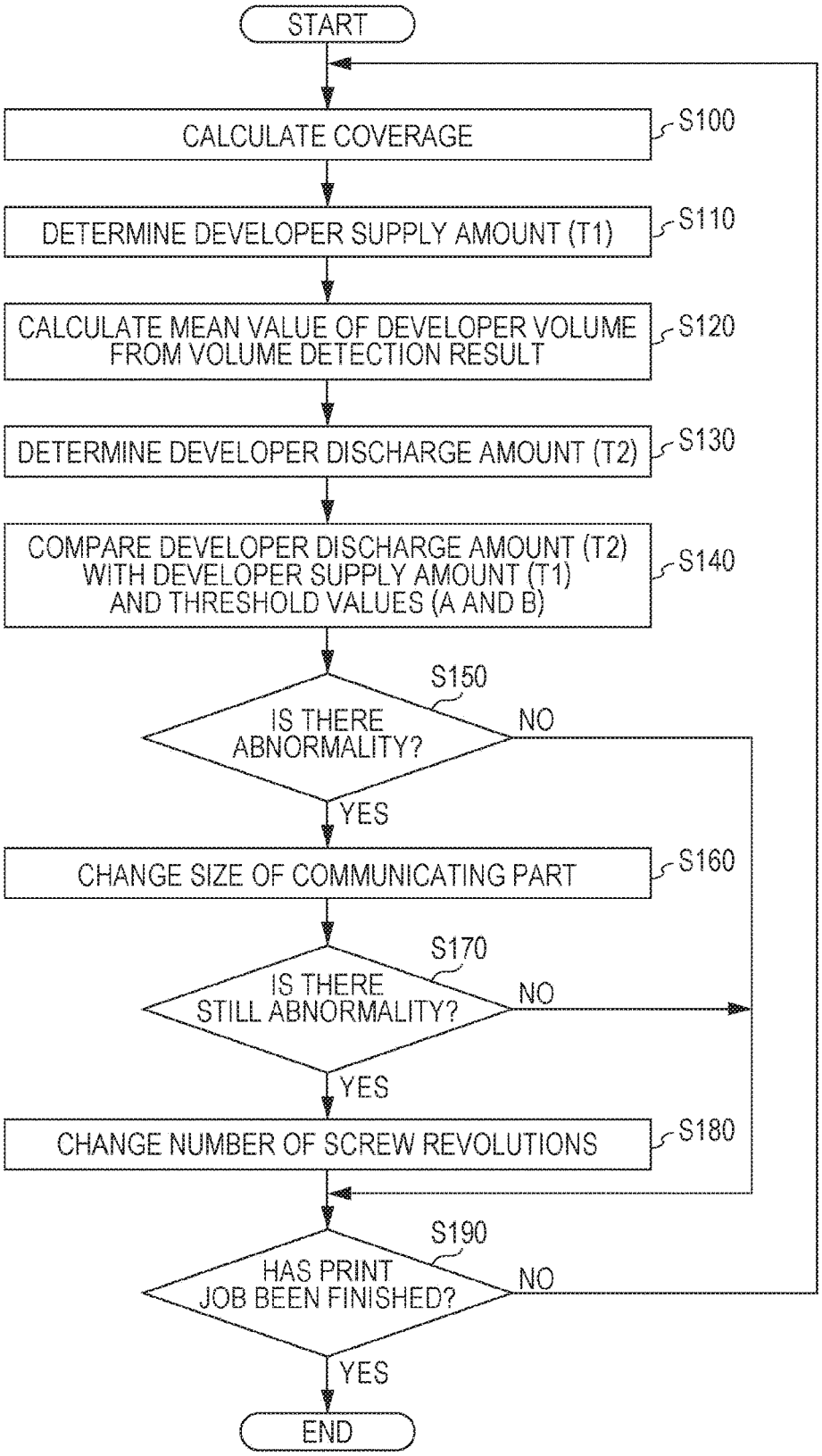
FIG. 11 is a flowchart showing control on the water level of the developer in the developing device during continuous printing by the image forming apparatus of this embodiment.

Next, the flow in a process for controlling the bulkiness of the developer in a case where printing is continuously performed on paper sheets S by the image forming apparatus 1 is described with reference to the flowchart shown in FIG. 11. Upon receiving a print job, the controller 100 repeatedly performs the processes in and after step S100, while monitoring signals output from the bulk detection sensor 360.

In step S100, the controller 100 controls the respective components to start printing on a paper sheet S in accordance with various kinds of data (input image data, user setting data, and the like) included in the print job, and calculates the coverage of the toner to be applied onto the paper sheet S (step S100). In a specific example of step S100, the controller 100 calculates coverage every few seconds by analyzing the toner replenishment values in the most recent replenishing operations or the output charts (see FIG. 8 and others) as appropriate. The controller 100 also performs the processes in and after step S110 every few seconds.

In step S110, the controller 100 determines the supply amount (T1) of the developer corresponding to the calculated coverage.

In step S120, the controller 100 calculates the mean value of the bulk of the developer in the first developing tank 270, in accordance with an output of the bulk detection sensor 360. That is, since the bulkiness of the developer that is being conveyed while adhering to the supply screw 250 and is detected by the bulk detection sensor 360 is constantly fluctuating (see FIGS. 6A and 6B and others), the mean value of the bulk is calculated, so that the more accurate amount of the developer to be discharged from the discharge port 352 is calculated.

In step S130, the controller 100 determines the discharge amount (T2) of the developer. In this example, the controller 100 determines the discharge amount (T2) of the developer to be the mean value of the developer bulk calculated in step S120.

In step S140, the controller 100 compares and collates the determined discharge amount (T2) of the developer with the supply amount (T1) of the developer determined in step S110 and the threshold values A and B described above.

In step S150, from the result of the comparison and the collation in step S140, the controller 100 determines whether the bulkiness of the developer in the first developing tank 270 is outside a predetermined range, or whether there is an abnormality related to the bulkiness.

Specifically, in step S150, the controller 100 determines whether the difference between T2 and T1 exceeds a predetermined value, and whether T2 is within the range from the threshold value A to the threshold value B. In a case where the difference is smaller than the predetermined value, and T2 is within the range from the threshold value A to the threshold value B, the controller 100 determines that there is no abnormality (NO in step S150). In a case where the difference is larger than the predetermined value, or where T2 is higher than the threshold value A or lower than the threshold value B, on the other hand, the controller 100 determines that there is an abnormality (YES in step S150). If it is determined that there is no abnormality (NO in step S150), the controller 100 skips step S190. If it is determined that there is an abnormality (YES in step S150), the process moves on to step S160.

In step S160, the controller 100 performs control to change the size (width) of the connecting part 330A in accordance with the bulkiness of the developer, as described above.

In step S170, the controller 100 again performs the above described processes in step S100 through step S140, and determines whether there is still an abnormality regarding the bulkiness of the developer. If it is determined that there is still an abnormality (YES in step S170), the controller 100 moves to step S180. If it is determined that a normal state has been established (NO in step S170), on the other hand, the controller 100 skips step S190.

In step S180, while monitoring detection signals from the bulk detection sensor 360, the controller 100 performs control to change the numbers of revolutions of the above described respective screws (240, 250, and 351) so that the value of the bulkiness of the developer in the first developing tank 270 falls within a predetermined range. That is, the controller 100 performs control to increase the rotation speeds of the screws in a case where the bulk is high, and performs control to lower the rotation speeds of the screws in a case where the bulk is high.

In step S190, the controller 100 determines whether the print job has been completed. As a result of the determination, if the print job has not been completed (NO in step S190), the controller 100 returns to step S100, and repeats the above described processes in and after step S100. If the controller 100 determines that the print job has been completed (YES in step S190), the controller 100 ends the above described series of processes.

With the image forming apparatus 1 of this embodiment for performing such control, it is possible to reduce fluctuations of the amount the developer in the developing device 412 while maintaining the highest possible printed image quality.

In the example structure described above, the partition member 335 moves in the lateral (horizontal) direction, to change the width of the connecting part 330A. In this manner, the amount of the developer moving from the second developing tank 260 to the first developing tank 270 is made variable.

In another example, the partition member 335 may be formed into a shutter-like member that can move in the longitudinal (vertical) direction, and the height of the partition member 335 in the connecting part 330A is changed. In this manner, the amount of the developer moving from the second developing tank 260 to the first developing tank 270 can also be made variable. Alternatively, the partition member 335 may be made movable in an oblique direction, and the area (the shape in a two-dimensional plane) of the connecting part 330A may be changed. Any other structures may be adopted, as long as the amount of the developer to be supplied from the second developing tank 260 to the first developing tank 270 can be changed.

The above described embodiment is merely a specific example of the present invention, and the technical scope of the invention should not be construed in a restrictive manner in accordance with the embodiment. That is, the present invention can be embodied in various forms, without departing from its scope or principal features.

Although embodiments of the present invention have been described and illustrated in detail, the disclosed embodiments are made for purposes of illustration and example only and not limitation. The scope of the present invention should be interpreted by terms of the appended claims.

What is claimed is:

1. A developing device comprising:

a developing roller that carries a developer;

a developing tank that supplies the developing roller with the developer replenished from a replenishing port, the developing tank including a first developing tank, a second developing tank, and a connecting part including a connecting path for circulating the developer between the first developing tank and the second developing tank formed between the first developing tank and the second developing tank;

a discharger that has a discharge port connecting to the developing tank and discharges the developer from the developing tank;

a supply amount acquirer that acquires a supply amount of the developer to be supplied to the developing tank;

a discharge amount acquirer that acquires a discharge amount of the developer to be discharged through the discharge port;

a developer amount adjuster that adjusts an amount of the developer in the developing tank, the developer amount adjuster including at least one of a partition member that moves to change a width of the connecting path of the connecting part and a conveyance member that conveys the developer in the developing tank while stirring the developer in the developing tank; and a hardware processor that controls the at least one of a position of the partition member and a speed of conveyance of the conveyance member to adjust the amount of the developer in the developing tank to a value within a predetermined range, in accordance with the acquired supply amount and the acquired discharge amount of the developer.

2. The developing device according to claim 1, wherein the first developing tank is connected to the discharger on a downstream side in a moving direction of the developer, and supplies the developer to the developing roller; and the second developing tank is connected to the replenishing port on an upstream side in a conveying direction of the developer.

3. The developing device according to claim 2, wherein the discharge amount acquirer acquires the discharge amount of the developer from a result of detection performed by a bulk detection sensor that detects bulkiness of the developer in the first developing tank.

4. The developing device according to claim 3, wherein the bulk detection sensor detects the bulkiness by measuring magnetic permeability of the developer in the first developing tank.

5. The developing device according to claim 3, wherein the bulk detection sensor is disposed immediately before the discharge port in the moving direction of the developer.

6. The developing device according to claim 2, wherein the developer amount adjuster includes the partition member that moves to change the width of the connecting path in the connecting part, and the hardware processor causes the partition member to move, to adjust the amount of the developer in the first developing tank to a value within the predetermined range.

7. The developing device according to claim 2, wherein the developer amount adjuster includes the conveyance member that conveys the developer in the developing tank to the discharge port while stirring the developer in the developing tank, and the hardware processor controls speed of conveyance of the developer being conveyed by the conveyance member, to adjust the amount of the developer in the first developing tank to a value within the predetermined range.

8. The developing device according to claim 6, wherein the partition member is capable of reciprocating in one of a width direction and a height direction of the connecting path.

9. The developing device according to claim 6, wherein the connecting path includes: an upstream-side path for supplying the first developing tank with the developer replenished from the replenishing port into the second developing tank; and a downstream-side path for returning the developer in the first developing tank into the second developing tank, and the partition member is located on the opposite side from the discharge port, and is movable to change width of the upstream-side path.

10. The developing device according to claim 2, wherein the supply amount acquirer acquires the supply amount from a replenishment amount of the developer supplied to the second developing tank from the replenishing port or coverage of an image printed on a paper sheet.

11. The developing device according to claim 3, wherein the hardware processor determines whether the amount of the developer in the first developing tank is outside a predetermined range in accordance with a result of detection performed by the bulk detection sensor and the supply amount, and, when determining that the amount of the developer in the first developing tank is outside the predetermined range, controls the developer amount adjuster to adjust the amount of the developer in the first developing tank to a value within the predetermined range.

12. The developing device according to claim 11, wherein, when a value detected by the bulk detection sensor exceeds a threshold value, the hardware processor determines that the amount of the developer in the first developing tank is outside the predetermined range.

13. The developing device according to claim 11, wherein the hardware processor collates values of the acquired discharge amount of the developer and the acquired supplied amount of the developer, and, from a result of the collation, determines whether the amount of the developer in the first developing tank is outside the predetermined range.

14. The developing device according to claim 13, wherein, when the result of the collation shows that transitions of the discharge amount and the supply amount do not match, the hardware processor determines that the amount of the developer in the first developing tank is outside the predetermined range.

15. The developing device according to claim 12, wherein at least one of the threshold value is set on each of an upper limit side and a lower limit side.

16. The developing device according to claim 12, wherein, when a value detected by the bulk detection sensor exceeds the threshold value for a certain period of time or longer, the hardware processor determines that the amount of the developer in the first developing tank is outside the predetermined range.

17. The developing device according to claim 3, wherein the developer amount adjuster includes: the partition member that moves to change the width of the connecting path in the connecting part; and the conveyance member that conveys the developer in the developing tank to the discharge port while stirring the developer in the developing tank, and the hardware processor preferentially controls a position of the partition member.

18. The developing device according to claim 17, wherein two thresholds are set on each of an upper limit side and a lower limit side, when a value detected by the bulk detection sensor exceeds a first threshold value on one of the upper limit side and the lower limit side, the hardware processor controls the position of the partition member, and, when a value detected by the bulk detection sensor exceeds a second threshold value on one of the upper limit side and the lower limit side, the hardware processor controls speed of conveyance of the developer being conveyed by the conveyance member.

19. The developing device according to claim 18, wherein the hardware processor determines whether to preferentially control the speed of conveyance of the developer being conveyed by the conveyance member, in accordance with a speed at which a value detected by the bulk detection sensor exceeds the first threshold value on one of the upper limit side and the lower limit side.

20. An image forming apparatus comprising the developing device according to claim 1.

* * * * *